US007404629B2

(12) United States Patent
Desire et al.

(10) Patent No.: US 7,404,629 B2
(45) Date of Patent: Jul. 29, 2008

(54) FRANKING MACHINE INCORPORATING AN INTEGRATED INK SUPPLY DEVICE

(75) Inventors: Régis Desire, Sceaux (FR); Hervé Duval, Paris (FR); Fabien Torche, Cerny (FR)

(73) Assignee: Neopost Technologies, Bagneux (FR)

( * ) Notice: Subject to any disclaimer, the term of this patent is extended or adjusted under 35 U.S.C. 154(b) by 322 days.

(21) Appl. No.: 10/865,410

(22) Filed: Jun. 10, 2004

(65) Prior Publication Data

US 2005/0001861 A1 Jan. 6, 2005

(30) Foreign Application Priority Data

Jun. 16, 2003 (FR) ..... 03 07215

(51) Int. Cl.
*B41J 2/175* (2006.01)

(52) U.S. Cl. ..... 347/86; 347/85

(58) Field of Classification Search ..... 347/2, 347/84, 85, 86
See application file for complete search history.

(56) References Cited

U.S. PATENT DOCUMENTS 4,527,175 A * 7/1985 Kojima et al. ..... 347/85
4,542,386 A * 9/1985 Delligatii et al. ..... 347/54
5,539,952 A * 7/1996 Hayes et al. ..... 15/321
5,874,976 A 2/1999 Katon et al. ..... 347/85
5,969,735 A 10/1999 Haigo ..... 347/85
5,992,989 A * 11/1999 Bainvel et al. ..... 347/86
6,012,807 A * 1/2000 Olsen et al. ..... 347/85
6,027,208 A * 2/2000 Amano ..... 347/70
6,145,968 A 11/2000 Fries et al. ..... 347/85
6,273,151 B1 * 8/2001 Kong ..... 141/18
6,520,630 B1 * 2/2003 Oda et al. ..... 347/85
6,783,218 B2 * 8/2004 Cheok ..... 347/86
2001/0015742 A1 * 8/2001 Childers ..... 347/85
2002/0097284 A1 * 7/2002 Vosahlo ..... 347/7
2002/0180848 A1 * 12/2002 Anderson ..... 347/86
2003/0189607 A1 * 10/2003 Bullock et al. ..... 347/5
2003/0206220 A1 * 11/2003 Childers et al. ..... 347/85
2004/0135859 A1 * 7/2004 German et al. ..... 347/95
2004/0223036 A1 * 11/2004 Inoue et al. ..... 347/85

* cited by examiner

*Primary Examiner*—An H. Do
*Assistant Examiner*—Sarah Al Hashimi
(74) *Attorney, Agent, or Firm*—Sughrue Mion, PLLC

(57) ABSTRACT

A franking machine including a printer for printing postal indicia on a mail item, a supplier for supplying postage printing ink to allow a refill of the printer with postage printing ink, and a self-obturating connection connected to the postage ink supply by an ink transferor and intended either to place the postage ink supply in communication with the printer in the case of postage ink printing or to isolate the postage ink supply from the printer in other cases of printing.

3 Claims, 6 Drawing Sheets

FRANKING MACHINE INCORPORATING AN INTEGRATED INK SUPPLY DEVICE

FIELD OF THE INVENTION

The present invention relates to the exclusive domain of mail handling and more particularly to an inkjet franking machine provided with an integrated ink supply device.

BACKGROUND OF THE INVENTION

U.S. Pat. No. 5,969,735 discloses a franking machine provided with an ink supply device which comprises an intermediate reservoir for regulating the level of ink delivered to the ejection nozzles of the printing module from a principal ink reservoir.

However, such a supply device appears complex and poorly adapted to the printing of postal indicia of which the slogan is of a colour different from that used for the postage printing ink. In effect, as this device continuously supplies the injection nozzles, it is necessary to provide as many devices as there are colours to be used, of which at least one for supplying postage printing ink (generally of a very specific colour), this resulting in a relatively expensive machine.

In addition, any problem arising at the level of the intermediate reservoir or of the principal ink reservoir automatically prohibits any fresh print.

It is an object of the present invention to overcome the afore-mentioned drawbacks by proposing a particularly high-performance franking machine which is nonetheless simple to use.

SUMMARY OF THE INVENTION

These objects are attained by a franking machine comprising means for printing postal indicia on a mail item and means for supplying postage printing ink to allow a refill of said printing means with postage printing ink, characterized in that it further comprises self-obturating connection means connected to said postage ink supply means by ink transfer means and intended either to place said postage ink supply means in communication with said printing means in the case of postage ink printing or to isolate said postage ink supply means from said printing means in the other cases of printing.

With this particular structure of selective supply of the printing means, during the phases of printing with postage ink, the printing means are thus in direct connection with the postage ink supply means while they are disconnected in the other cases of print. It is thus possible, without resorting to a complex machine structure, to obtain prints in several colours, very simply.

Regulating means are preferably disposed at the outlet of said postage ink supply means in order to regulate the pressure of ink supplying said printing means.

The postage ink supply means are advantageously mounted above said printing means so as to allow the postage ink to flow by gravity.

According to a preferred form of embodiment, the printing means comprise a receiving housing rendered air-tight by closure means and provided with at least one postage ink cartridge having an ink inlet port. The air-tight receiving housing may comprise two postage ink cartridges each comprising an ink inlet port and connection means of "T" type allowing the transfer of the ink from the self-obturating connection means towards the inlet ports of each of these two ink cartridges.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
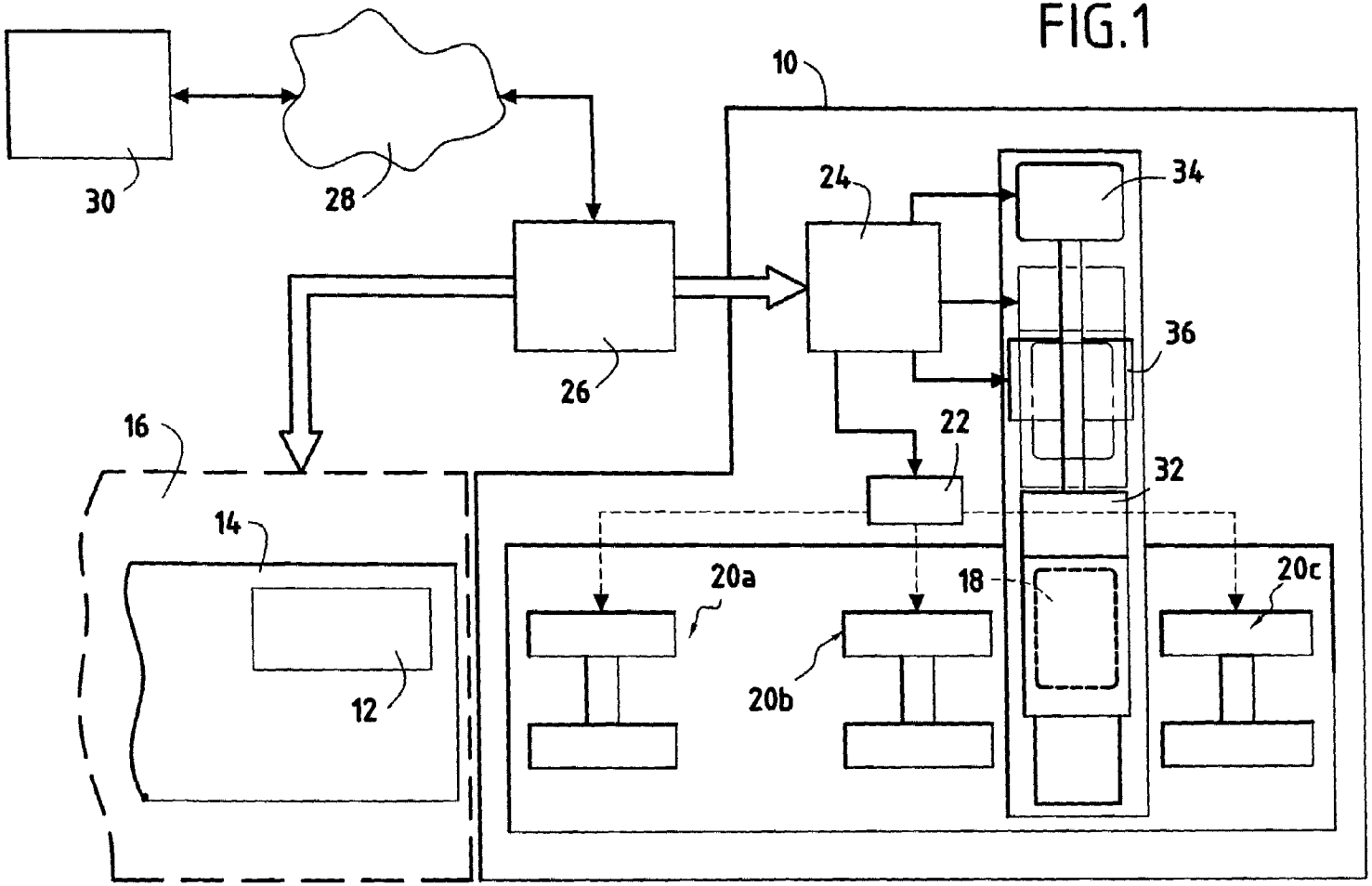
FIG. 1 schematically shows the material structure of a franking machine.

Referring now to the drawings, FIG. 1 very schematically illustrates the general architecture of a machine for franking mail items. This machine 10, intended for printing postal indicia 12 on a mail item 14, such as an envelope or a label, and which may be disposed directly at the exit of a folding/insertion module 16, comprises disposable inkjet printing means 18 for printing the postal indicia on this mail item, means for conveying the mail items through the machine formed by a plurality of series of conveyor rollers, for example 20*a*, 20*b* and 20*c*, actuated by first motorization means 22, and means 24 for accounting the frankings (in particular ascending and descending meters) and for control and sychronization of the phases of conveyance and of printing of the mail items in the machine as a function of the rate of arrival of these items.

These general control means may be connected to an outside computer 26 which, in principle, also ensures control of the folding/insertion module. This computer is preferably connected to an outside server 30 of the Postal Service or of the exclusive agent for the franking machine through a communications network 28.

The printing means are mounted on a mobile carriage 32 which, under the action of second motorization means 34 actuated from the control means 24, may move (for example via an endless screw) between a first position corresponding to a normal position of operation of the printing means (current position for printing the postal indicia) and a second position corresponding to a position of rest (or simply of temporary standby) or of maintenance. In this rest position, illustrated in phantom lines in FIG. 1, the printing means are disposed opposite a maintenance station 36, for example of the type described in Applicants' French Patent Application published under No. 2 768 078, comprising at least scraping means for ensuring cleaning thereof and protection means for avoiding the ink drying in the absence of printing.

Figure 2:
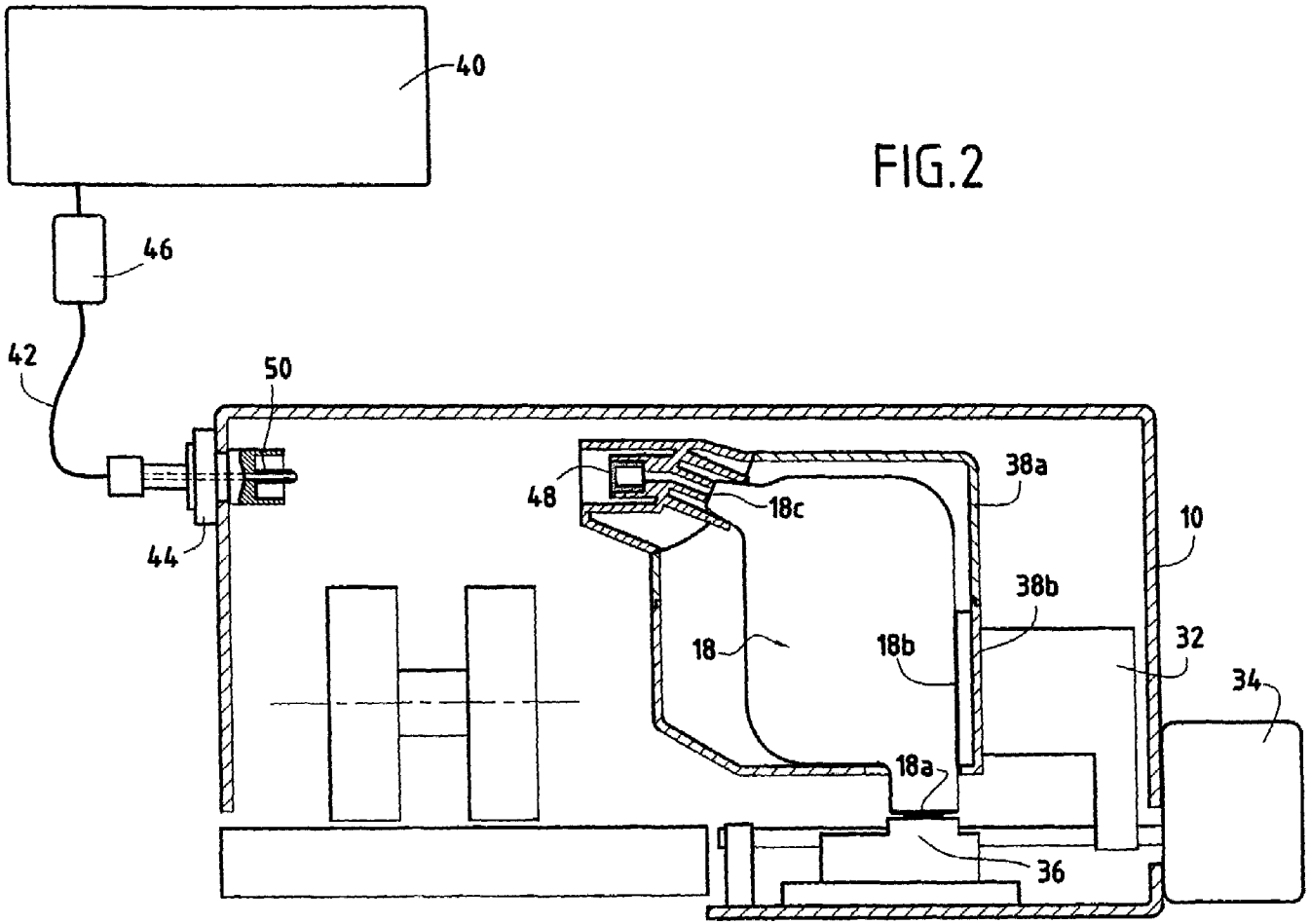
FIGS. 2 and 3 are views in section of a franking machine according to the invention equipped with a refillable postage ink cartridge at the level of its printing means respectively in a position of maintenance and in a position of normal operation.
Figure 3:
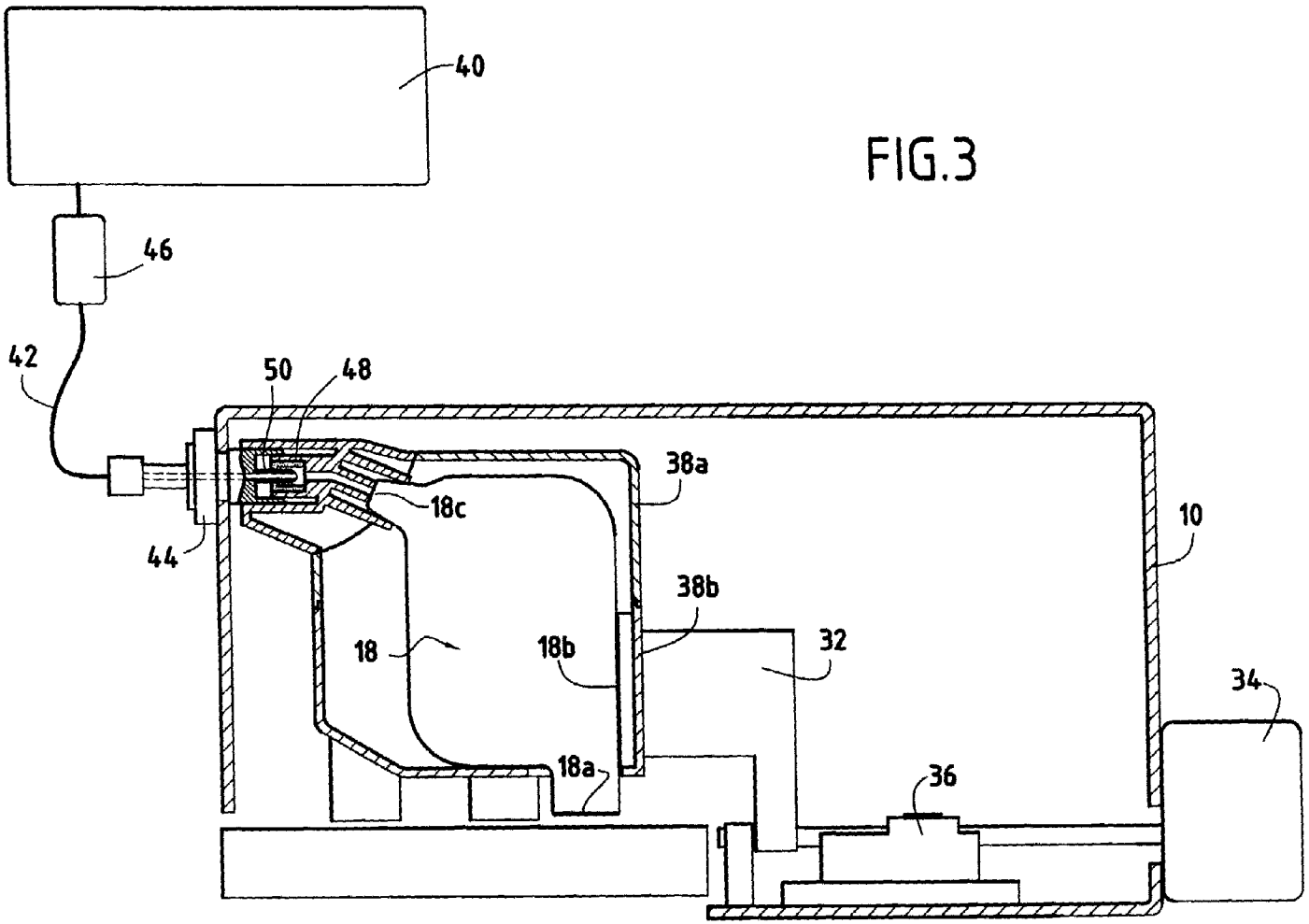

As shown in FIGS. 2 and 3, the inkjet printing means 18 which are of disposable type, i.e. formed by a disposable ink cartridge integrating injection nozzles 18*a* controlled from the control means 24 and a linking connector 18*b*, are mounted in a receiving housing advantageously formed by two housing parts 38*a*, 38*b* which fit in each other to form an air-tight receptacle.

According to the invention, the franking machine further comprises postage ink supply means, constituted by a principal reservoir 40, connected via ink transfer means such as a fixed tube 42, to connection means 44 of the self-obturating type.

The principal reservoir is preferably mounted above the printing means, for example beneath the cover of the franking machine, and the postage ink may therefore flow by gravity between the reservoir and the connector. Regulation means 46 are, however, connected at the outlet of the reservoir to regulate the pressure of ink supplying the printing means. When the reservoir is disposed otherwise, a pump (not shown) may advantageously be mounted in the hydraulic circuit between the reservoir 40 and the self-obturating connector 44 to ensure a perfect circulation of the ink in this circuit.

Figure 4:
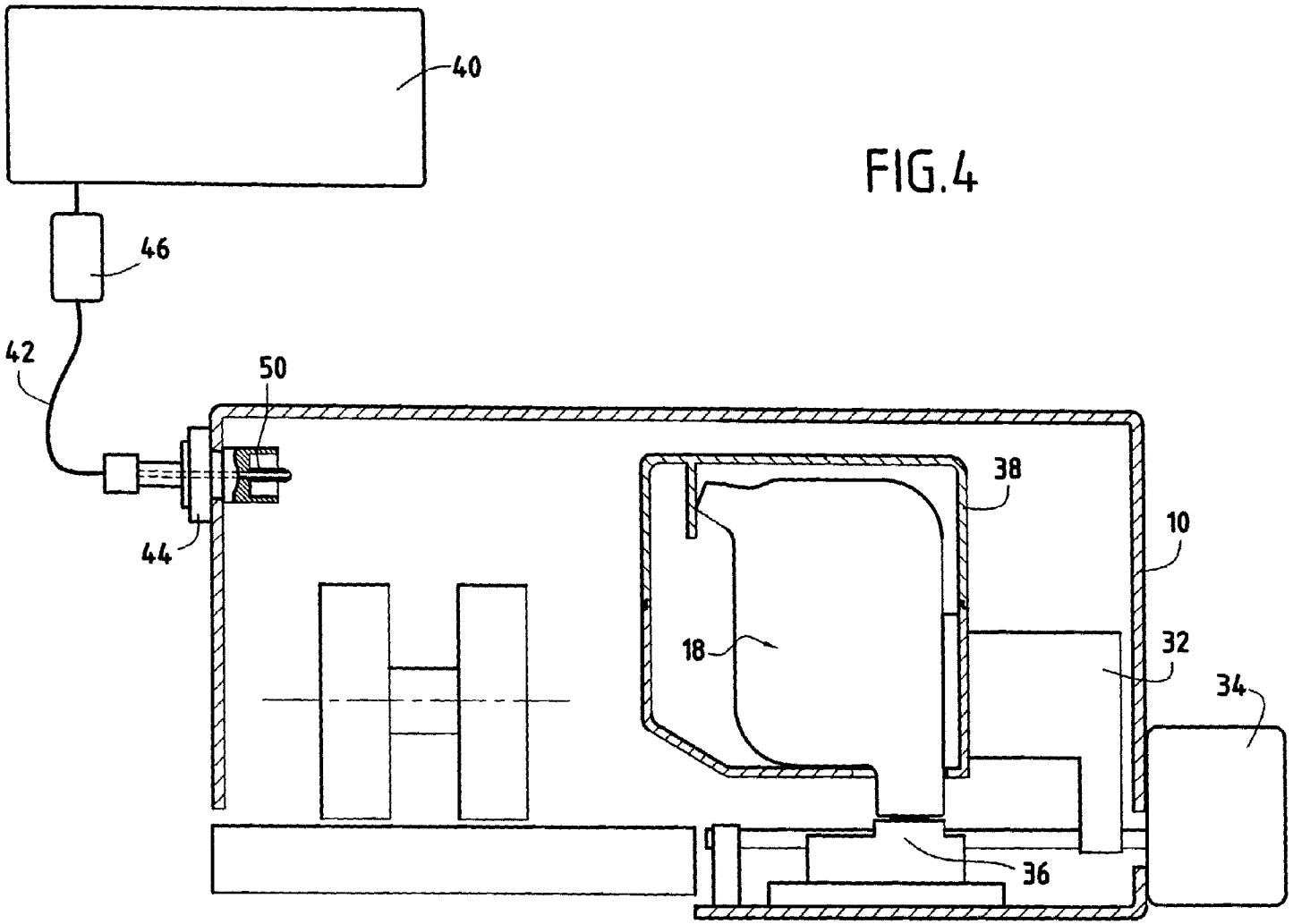
FIGS. 4 and 5 are views in section of a franking machine according to the invention equipped with a standard ink cartridge at the level of its printing means respectively in a position of maintenance and in a position of normal operation.
Figure 5:
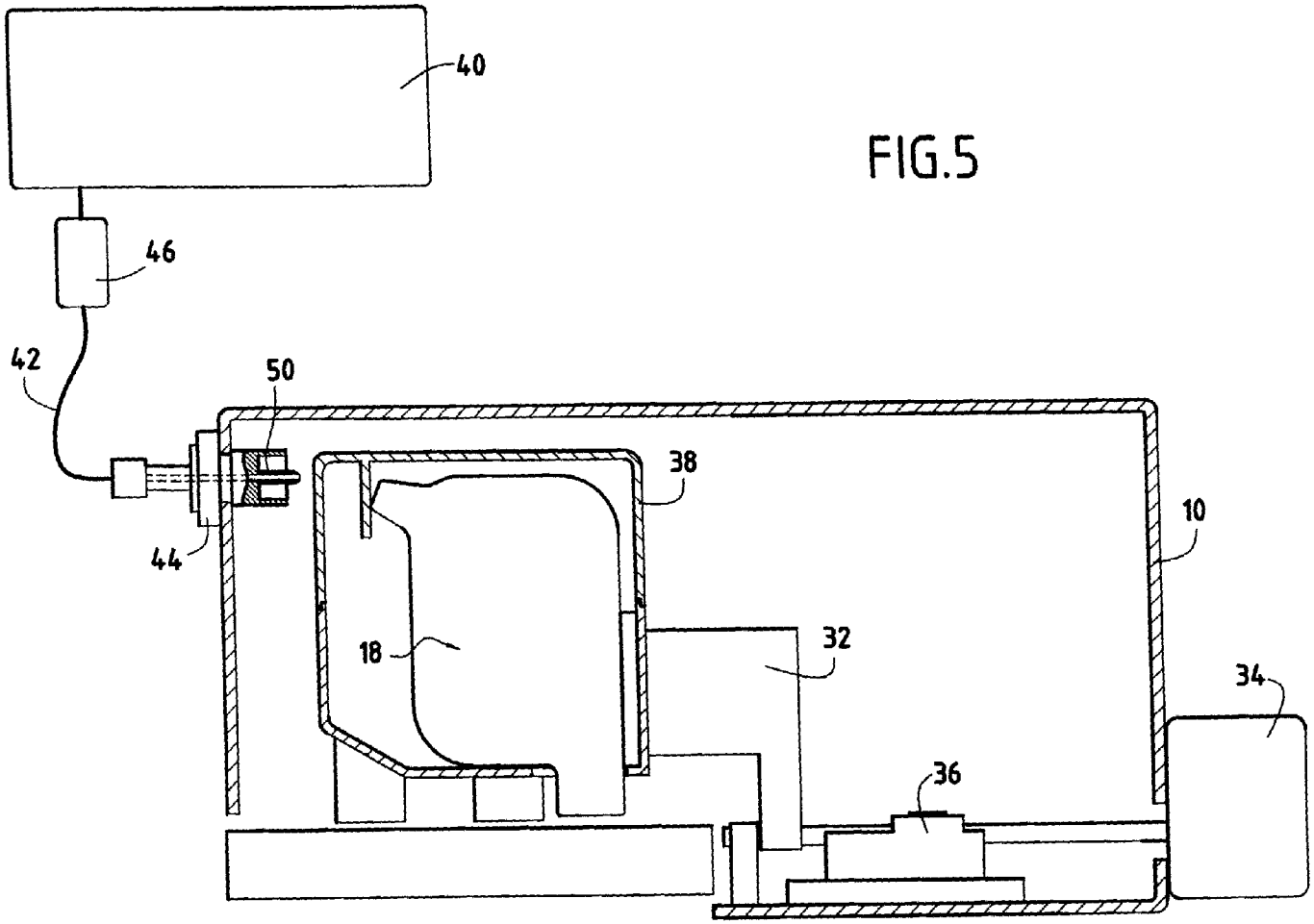

In order to allow its refill with postage ink, the disposable postage ink cartridge 18 comprises an ink inlet orifice 18*c* and the housing 38*a*, 38*b* for receiving this cartridge comprises tight closure means 48 for isolating the ink cartridge when it is not in position of operation (and therefore in position of refill) and therefore maintaining the ink that it contains under pressure. Similarly, the self-obturating connector conventionally comprises a perforated needle 50 intended to cooperate with these tight closure means, advantageously a supple membrane forming seal mounted opposite the inlet orifice 18*c*, to ensure the transfer of the postage ink. In this way, in position of printing (FIG. 3), the ink may flow freely from the reservoir 40 towards the printing means 18 through the self-obturating connector 44 then in "open" position. On the contrary, in position of rest or of maintenance (FIG. 2), the ink cartridge 18 is detached from the connector 44 and isolated via closure means 48 and the supply of postage ink is then automatically stopped by the self-obturation capacity of the connector 44 then in "closed" position. In this position, a change of ink type and/or colour does not raise any particular problem, it suffices to proceed with changing the housing containing the postage ink cartridge which may then be replaced by a standard disposable housing 38 containing a standard ink cartridge of any colour, this non-refillable cartridge not having an ink inlet orifice, as illustrated in FIG. 4. The printing may then be continued, like in a conventional machine, with the new housing in the position of operation of FIG. 5, the postage ink reservoir 40 being inactive, the flow of the postage ink being stopped by the self-obturating connector 44.

Figure 6A:
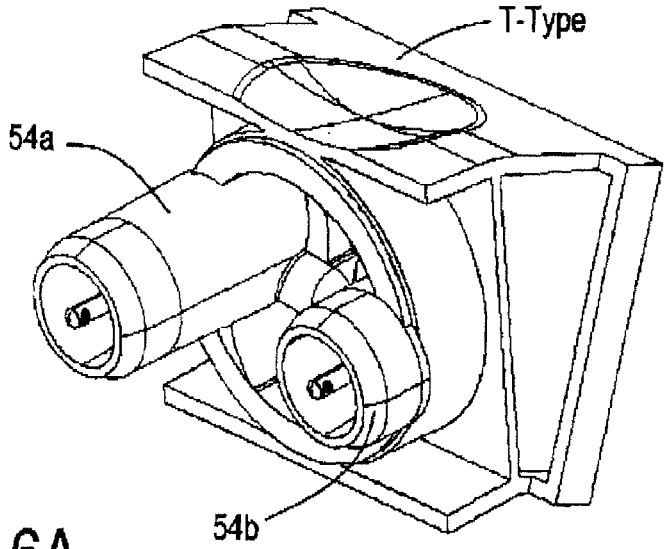
FIGS. 6A and 6B are isometric views of a T-Type connector in accordance with an embodiment.
Figure 6B:
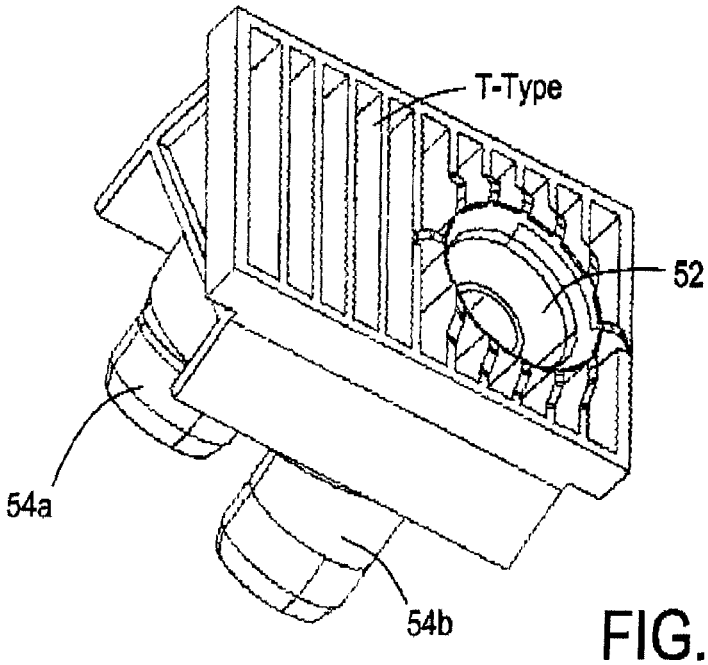

With this specific architecture and with respect to a conventional machine, it is no longer necessary to proceed with the regular changes of the printing means which become refillable via the postage ink reservoir. When these printing means comprise two disposable postage ink cartridges, the receiving housing 38*a*, 38*b* advantageously comprises connection means of "T" type (See FIGS. 6A-6B) to allow the transfer of the postage ink from the self-obturating cormector 44 towards the two inlet orifices of each of these two cartridges. Referring to FIGS. 6A-6B, input connector 52 directly cooperates with needle 50 of connector 44 and the output connectors 54*a*, 54*b* are inserted in each receiving housing 38 of each postal ink cartridge. In addition, contrary to the machine structure mentioned in the preamble, it becomes possible to print with inks of different colours. For example, if it is desired to print the slogan or bar codes with a black ink while the reservoir and the current printing means contain the red postage ink necessary for printing the postal data in accordance with regulations, it suffices to replace the sole red-ink printing means by standard black ink printing means, therefore not having any ink inlet orifice. Printing with black ink may, in effect, continue, the connection to the red ink reservoir having, of course, become impossible due to this absence of inlet orifice and the flow of the postage ink being stopped due to the faculty of obturation of the connector 44.

It may also be noted that the self-obturating connector being fast with the body of the franking machine in a determined position and the reservoir likewise, the tube which connects them is therefore fixed. This results in a not inconsiderable advantage in terms of dimensions and especially of wear and tear with respect to the device of the prior art mentioned hereinabove.

Similarly, the addition of this postage ink reservoir does not change the conventional operation of the printing means of a standard machine which may therefore continue their printing (provided, of course, they still have sufficient ink available) even in the case of problems, for example at the level of the regulation means.

What is claimed is:

1. Franking machine comprising:

means for printing postal indicia on a mail item;

means for supplying postage printing ink to allow a refill of said printing means with postage printing ink; and self-obturating connection means connected to said postage ink supply means by ink transfer means, the self-obturating connection means being configured to place said postage ink supply means in communication with said printing means in the case of postage ink printing and to isolate said postage ink supply means from said printing means in other cases of printing, wherein said printing means comprise a receiving housing rendered air-tight by closure means and provided with at least one postage ink cartridge having an ink inlet port;

wherein said air-tight receiving housing comprises two postage ink cartridges each comprising an ink inlet port and connection means of "T" type allowing the transfer of the ink from the self-obturating connection means towards the inlet ports of each of these two ink cartridges.

2. The franking machine of claim 1, further comprising regulating means disposed at the outlet of said postage ink supply means in order to regulate the pressure of ink supplying said printing means.

3. The franking machine of claim 1, wherein said postage ink supply means are mounted above said printing means so as to allow the postage ink to flow by gravity.

* * * * *